US010259630B2

(12) United States Patent
Gatteschi

(10) Patent No.: US 10,259,630 B2
(45) Date of Patent: Apr. 16, 2019

(54) BUNDLE OF CONTAINERS, IN PARTICULAR BOTTLES, CANS OR THE LIKE

(71) Applicant: OCME s.r.l., Parma (IT)

(72) Inventor: Carlotta Gatteschi, Parma (IT)

(73) Assignee: OCME S.R.L., Parma (IT)

( * ) Notice: Subject to any disclaimer, the term of this patent is extended or adjusted under 35 U.S.C. 154(b) by 417 days.

(21) Appl. No.: 15/035,022

(22) PCT Filed: Jul. 15, 2014

(86) PCT No.: PCT/IB2014/063110
§ 371 (c)(1),
(2) Date: May 6, 2016

(87) PCT Pub. No.: WO2015/068060
PCT Pub. Date: May 14, 2015

(65) Prior Publication Data

US 2016/0264331 A1 Sep. 15, 2016

(30) Foreign Application Priority Data

Nov. 8, 2013 (IT) ..... MI2013A1857

(51) Int. Cl.
*F25D 3/08* (2006.01)
*B65D 75/00* (2006.01)
(Continued)

(52) U.S. Cl.
CPC ..... *B65D 71/0007* (2013.01); *B65D 5/241* (2013.01); *B65D 5/40* (2013.01);
(Continued)

(58) Field of Classification Search
USPC ..... 206/427, 428, 432, 497, 193
See application file for complete search history.

(56) References Cited

U.S. PATENT DOCUMENTS 1,310,161 A 7/1919 Johnson
1,919,428 A 7/1933 Foreman
(Continued)

FOREIGN PATENT DOCUMENTS

DE 2646735 A1 4/1977
EP 2463209 A1 6/2012

OTHER PUBLICATIONS

PCT/IB2014/063110, International Searching Authority, International Search Report, dated Oct. 7, 2014.
(Continued)

*Primary Examiner* — Jacob K Ackun
(74) *Attorney, Agent, or Firm* — Ice Miller LLP

(57) ABSTRACT

A bundle of containers like bottles or cans comprises a structure (2) for holding containers (3), having a base wall (4) intended to support the containers (3) and lateral walls (5) extending from the base wall (4), which define a compartment (6) intended for the support of the containers (3). The compartment (6) is impermeable for receiving a predefined amount of ice intended for cooling the containers. The bundle (1) also comprises a wrapping (7) made of thermoretractable plastic material which wraps the structure (2) for holding containers (3) and the containers (3) arranged therein. The wrapping (7) has at least one access opening (8) for the introduction of the ice into the housing compartment (6) of the structure (2) for holding containers (3). An optional spacer between containers provides gaps for receiving the coolant.

20 Claims, 5 Drawing Sheets

(51) Int. Cl.

| | |
|---|---|
| ***B65D 71/54*** | (2006.01) |
| ***B65D 71/10*** | (2006.01) |
| ***B65D 75/58*** | (2006.01) |
| ***B65D 5/24*** | (2006.01) |
| ***B65D 5/42*** | (2006.01) |
| ***B65D 5/40*** | (2006.01) |
| ***B65D 61/00*** | (2006.01) |
| ***B65D 81/22*** | (2006.01) |

(52) U.S. Cl.

CPC ..... *B65D 5/4266* (2013.01); *B65D 61/00* (2013.01); *B65D 71/10* (2013.01); *B65D 75/5833* (2013.01); *B65D 81/22* (2013.01); *F25D 3/08* (2013.01); *F25D 2303/081* (2013.01); *F25D 2303/0841* (2013.01); *F25D 2303/0843* (2013.01); *F25D 2303/0846* (2013.01)

(56) References Cited

U.S. PATENT DOCUMENTS 2,154,101 A 4/1939 Maurer, Jr.
2,979,227 A * 4/1961 Taber ..... F25D 3/08 206/169
3,119,494 A 1/1964 Rosenstiel
3,338,404 A 8/1967 Becker et al.
3,595,384 A 7/1971 Sargent et al.
4,062,448 A * 12/1977 Meighan ..... B65D 71/10 206/432
4,077,516 A * 3/1978 Duerr ..... B65D 71/0085 206/432
4,304,332 A 12/1981 Danti
4,730,748 A * 3/1988 Bane ..... B65D 81/3823 206/497
4,819,793 A * 4/1989 Willard ..... A45C 3/04 206/162
6,164,526 A * 12/2000 Dalvey ..... B65D 5/0005 206/427
6,360,558 B1 * 3/2002 Woog ..... A45C 11/20 206/141
6,631,803 B2 * 10/2003 Rhodes ..... B65D 5/542 206/427
6,802,802 B2 * 10/2004 Woog ..... A45C 11/20 206/141
6,874,633 B2 * 4/2005 Andersen ..... B65B 15/00 206/427
7,097,034 B2 * 8/2006 Woog ..... A45C 11/20 206/147
7,370,761 B2 * 5/2008 Andersen ..... B65D 71/10 206/432
7,392,905 B2 * 7/2008 Andersen ..... B65B 15/00 206/427
7,748,603 B2 * 7/2010 Fogle ..... B65D 71/36 206/427
7,806,314 B2 * 10/2010 Sutherland ..... B65D 71/36 206/427
8,556,160 B2 * 10/2013 Spivey, Sr. ..... B65D 71/36 206/427
2003/0213705 A1 * 11/2003 Woog ..... A45C 11/20 206/162
2004/0031842 A1 2/2004 Westerman
2004/0040334 A1 * 3/2004 Rusnock ..... B65D 71/36 62/371
2007/0080087 A1 4/2007 Lentner et al.
2007/0141208 A1 6/2007 Nukuto et al.
2008/0099544 A1 * 5/2008 Skolik ..... B65D 71/36 229/117.13
2012/0292378 A1 11/2012 Smith et al.
2015/0014190 A1 * 1/2015 Harden ..... B65D 71/0003 206/162
2015/0151889 A1 * 6/2015 Kastanek ..... B65D 71/36 206/427

OTHER PUBLICATIONS

PCT/IB2014/063110, International Searching Authority, Written Opinion, dated Oct. 7, 2014.

* cited by examiner

BUNDLE OF CONTAINERS, IN PARTICULAR BOTTLES, CANS OR THE LIKE

CROSS-REFERENCE TO RELATED APPLICATIONS

The present application is a U.S. national stage of, and claims the priority benefit of, International Patent Application Serial No. PCT/IB2014/063110, filed Jul. 15, 2014 and Italian Patent Application Serial No. MI2013A001857, filed Nov. 8, 2013, the text and drawings of which are hereby incorporated by reference in their entireties.

The present invention refers to a bundle of containers, in particular bottles, cans or the like.

The object of the present invention aims at the industry for packaging bottles or cans which can be easily found in distribution centres.

As known, the bottles and/or cans intended for packaging food products of the liquid type, such as water, beverages and/or the like, are usually grouped into bundles which facilitate transport, storage and sales thereof.

There are various types of bundles and/or packagings which differ in terms of shape, arrangement of the containers and the used materials.

Actually, there are known cardboard bundles as well as bundles obtained from wrapping plastic films, of thermoretractable type, capable of compacting the content thereof.

In addition, there are known bundles with gripping handles and decomposable bundles, i.e. provided with suitable cutting and/or breaking lines for the division of the same into several parts or under groups of containers.

Though the known bundles allow overcoming several drawbacks ranging from transport to storing the containers, such bundles do not facilitate the operations of cooling the containers using ice, mainly during outdoor activities such as for example picnics, excursions and/or the like or during private and/or public social events such as get-together events, meetings and the like.

In particular, the Applicant observed that during the aforementioned outdoor and/or social events, there arises the need to have suitable containers which are filled with ice for receiving the bottles and/or cans, previously removed from the respective bundles, to be cooled.

The main object of the present invention is to provide a bundle of containers, in particular bottles, cans or the like, capable of overcoming the problems observed in the prior art.

An object of the present invention is to provide a bundle capable of containing a predefined amount of ice required for cooling the containers present therein.

Another object of the present invention is to simplify the preparations for outdoor or social activities.

Another object of the present invention is to prevent the use of cumbersome recipients for cooling the containers.

These and other objects are substantially obtained by a bundle of containers, in particular bottles cans or the like, as outlined and described in the following claims.

Below there is the description, by way of non-exclusive example, of a preferred embodiment, of a bundle of containers, in particular bottles, cans or the like, according to the present invention.

The description shall be outlined hereinafter with reference to the attached drawings, provided solely for indicative and thus non-limiting purposes, wherein.

Figure 1:
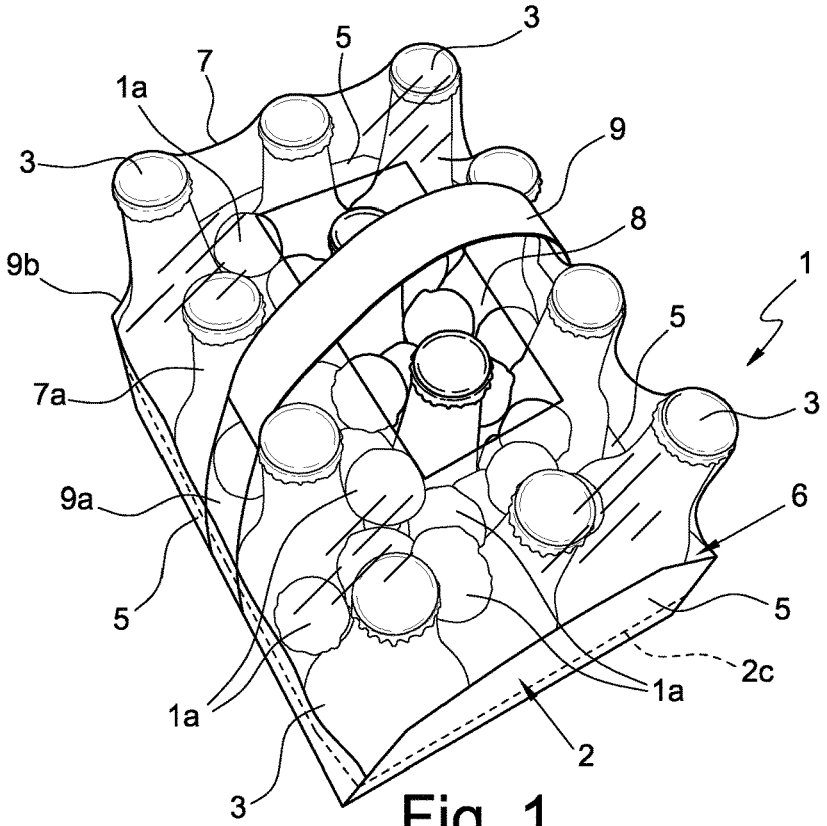
FIG. 1 is a top perspective view of a bundle of containers, in particular bottles, cans or the like, according to the present invention.

With reference to FIGS. 1, 2, and 9 to 11, a bundle of containers, in particular bottles, cans or the like, according to the present invention is indicated in its entirety with 1.

As observable in FIGS. 1, 2, and 9 to 11, the bundle comprises a structure 2 for holding containers 3, provided with at least one base wall 4 intended to support a plurality of containers 3 and at least one lateral wall 5 which extends transversely, preferably perpendicularly, perimetrically from the base wall 4.

According to the embodiment illustrated in FIGS. 1, 2, 6, and 9 to 11, the structure 2 for holding containers 3 is provided with four lateral walls 5 which extend perimetrically from the base wall 4 to define a concave box-shaped structure.

The base wall 4 and the lateral walls 5 define a housing compartment 6 open at the upper part and intended to support the aforementioned containers 3.

Advantageously, the housing compartment 6 is impermeable so as to be able to receive a predefined amount of coolant 1*a* (FIG. 1), liquid or solid, such as for example ice.

Figure 3:
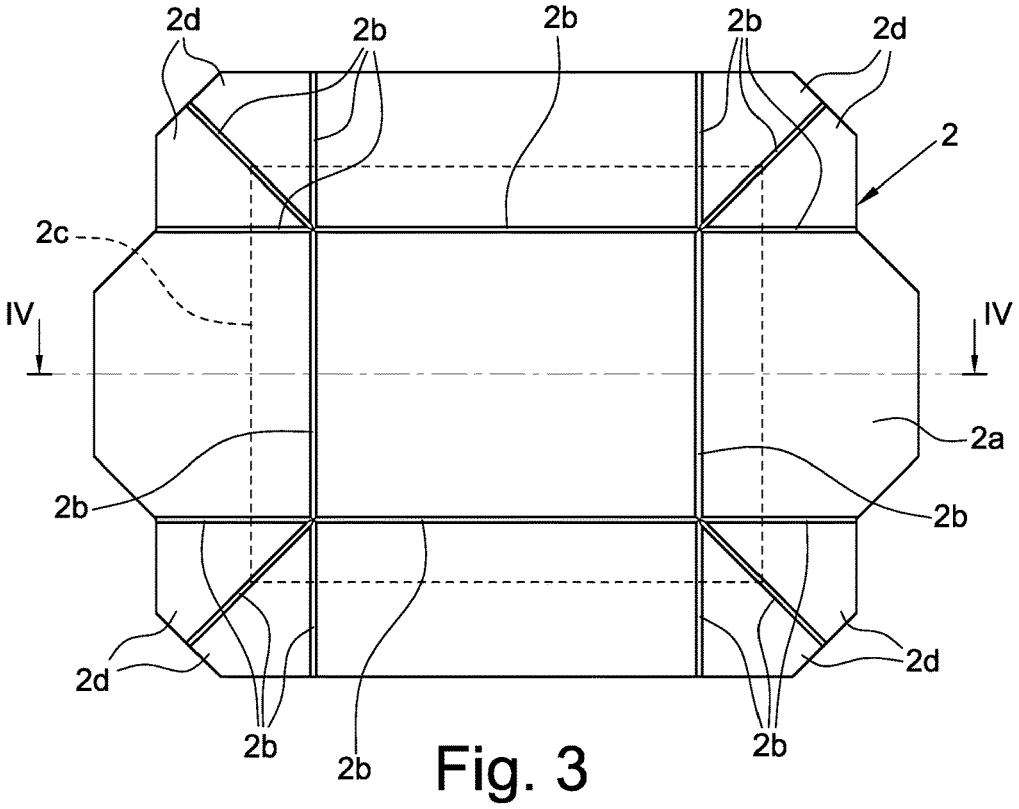
FIG. 3 is a plan view of a blanking regarding a particular of the bundle subject of FIG. 1.
Figure 4:
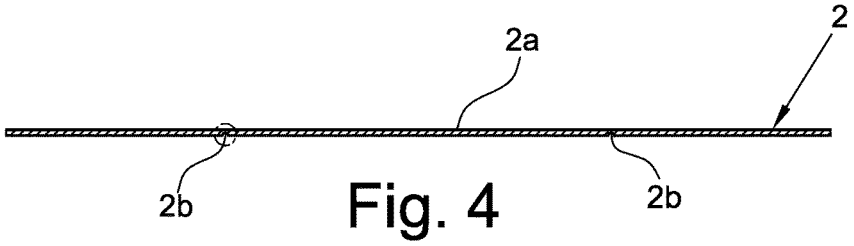
FIG. 4 is a longitudinal section, performed along line IV-IV, of the blanking subject of FIG. 2.
Figure 5:
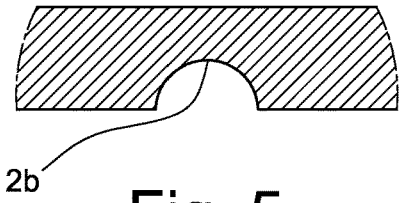
FIG. 5 is an enlargement of a detail of the blanking illustrated in FIG. 3.
Figure 6:
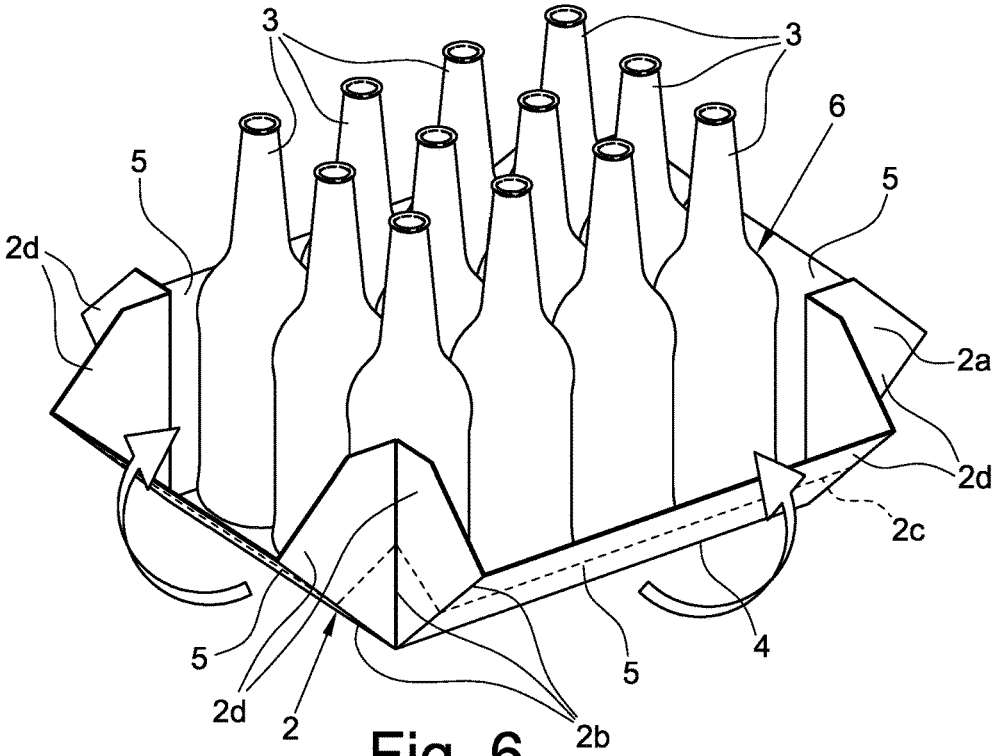
FIG. 6 is a perspective representation of the blanking subject of FIGS. 3 to 5 illustrated during a bending step of the same.

The structure 2 for holding containers 3 is made of a single piece, optionally starting from a sheet 2*a* (FIGS. 3 to 5). Preferably, the sheet 2*a* is made of cardboard or a similar paper material, whose surface intended to define the housing compartment 6 is suitably made impermeable, preferably using one or more hydrophobic substances, such as for example paraffin, resins and/or the like.

Alternatively, the sheet 2*a* for the formation of the structure 2 for holding containers 3, is plasticised or it is entirely made of a plastic rigid or semi-rigid impermeable material.

As observable in FIGS. 3 to 5, the aforementioned sheet 2*a* has a plurality of bending lines 2*b* through which it is possible to form the structure 2 for holding containers 3, which may be fixed in the final position (FIGS. 1 and 2) through suitable gluing and/or welding points.

As observable in the enlargement of FIG. 5, each bending line 2*b* is obtained through a section reduction which is obtained on the surface opposite to the surface relative to the housing compartment 6 impermeable, i.e. on the surface faced outwards.

In addition it should be observed that the bending lines may also be obtained on the surface intended to define the housing compartment 6, i.e. on the surface faced inwards.

Advantageously, the bending lines 2*b* are also treated and made impermeable, at least at the housing compartment 6, for preventing losses of coolant 1*a* during the utilisation of the bundle 1.

The formation of the housing compartment 6 starting from the cardboard or plastic sheet 2*a* may be obtained around a group of containers 3 to be packaged (FIG. 6) or before the positioning of the same in the housing compartment 6.

With the aim of ensuring optimal cooling of the containers 3 during the use of the bundle 1 and containment the overall volume of the coolant 1*a* used, the lateral walls 5 of the structure 2 for holding containers 3 extend vertically by at least one third of the height of the held containers 3, preferably by at least half of the height of the held containers 3, even more preferably by at least two thirds of the height of the containers 3.

Figure 2:
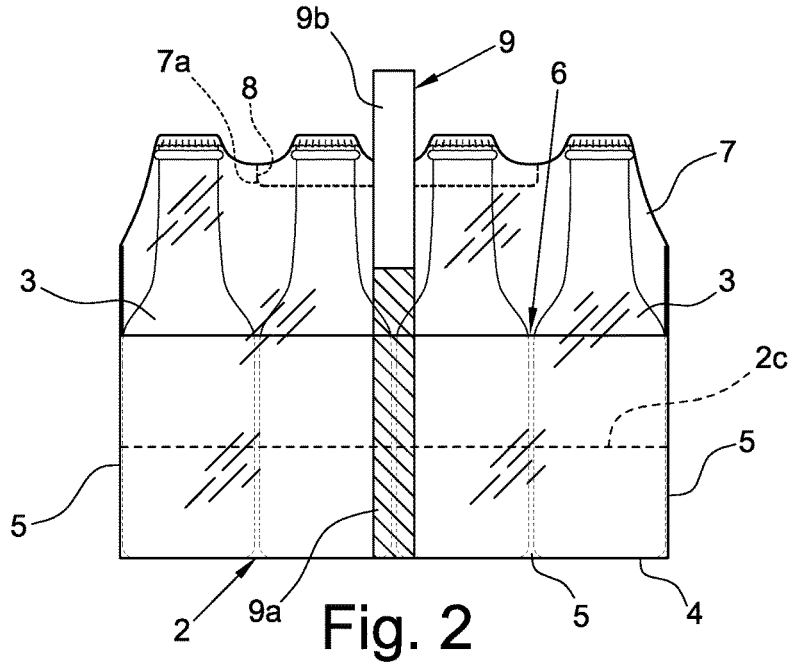
FIG. 2 is an elevational view of the bundle subject of FIG. 1.

As observable in FIG. 2, the lateral walls 5 of the structure 2 for holding containers 3 may have different heights depending on the type of packaging or bundles to be obtained.

As observable in FIGS. 1, 2 and 9 to 11, the bundle 1 comprises at least one wrapping 7 made of thermoretractable plastic material which wraps the structure 2 for holding containers 3 and the containers 3 arranged therein.

The wrapping 7 adheres externally to the base wall 4, to the lateral walls 5 and to the upper part of at least one of the containers 3 arranged in the housing compartment 6.

As observable in FIGS. 1 and 2, the wrapping 7 circumscribes, compacting, the structure 2 for holding containers 3 and the containers 3 arranged therein.

In this case, the structure 2 for holding containers 3 has the purpose of providing an impermeable volume suitable to receive the coolant 1*a* to be used, while the wrapping 7 exclusively performs the structural function of the bundle 1, conferring shape and consistency to the same.

Optionally, the bundle 1 is provided with sealing means 2*c*, indicated by a dashed line in FIGS. 1 to 3 and 6, interposed between the structure 2 for holding containers 3 and the wrapping 7 for preventing the leakage of the coolant 1*a* from the housing compartment 6 along the lateral walls 5.

As observable in FIGS. 1 to 3 and 6, the sealing means 2*c* develop externally on the structure 2 for holding containers 3 along the entire perimeter development of the housing compartment 6. In other words, the sealing means 2*c* develop along all the lateral walls 5 of the structure 2 for holding containers 3 parallel to the base wall 4.

More in detail, the sealing means 2*c* comprise at least one layer in a sealing material, such as for example, glue, resin, rubber and/or the like, which is applied substantially perimetrically, optionally peripherally, on the surface of the sheet 2*a* intended to face towards to the outside.

As observable in FIG. 3, the layer of sealing material of the sealing means 2*c* is advantageously applied also at angle areas 2*d* (FIGS. 3 and 6) of the sheet 2*a*, so as to contribute or even replace the gluing and/or welding points which guarantee the stability of the formed structure 2 for holding containers 3.

According to a further advantageous aspect of the present invention, the sealing material of the sealing means 2*c* is adapted to be welded or joined to the wrapping 7 of the bundle 1 following an activation operation, which can be of the mechanical type, such as for example pressing or adhesion, or of thermal type, such as for example heating, or of the chemical type following one or more chemical reactions.

The provision of the sealing means 2*c* considerably increases the overall and impermeable volume of the housing compartment 6 which is thus defined both by the structure 2 for holding containers 3 and the wrapping 7 wrapped around it.

Advantageously, the wrapping 7 is provided with at least one access opening 8, optionally a plurality, for the introduction of the liquid and/or solid coolant 1*a* into the housing compartment 6 of the structure 2 for holding containers 3.

Each access opening 8 is defined by at least one structural weakening line 7*a* which is obtained directly in the wrapping 7, advantageously by drilling or cutting the wrapping itself. The structure of the wrapping 7 may thus be broken and/or torn to allow the formation of the respective access opening 8.

Advantageously, the bundle 1 provides for suitable closing means (not represented), optionally of adhesive type, for closing the access opening 8.

Alternatively, the closing means may be obtained directly on the wrapping 7 so that the structure strip removed therefrom following the breaking of the weakening line 7*a* may be used for closing the access opening 8 defined.

The bundle may also be provided with a gripping handle 9 which provides for respective adhesive portions 9*a* externally engaged on opposite parts of the wrapping 7 and a non-adhesive gripping portion 9*b* which lies astride the upper area of the wrapping 7.

Figure 7:
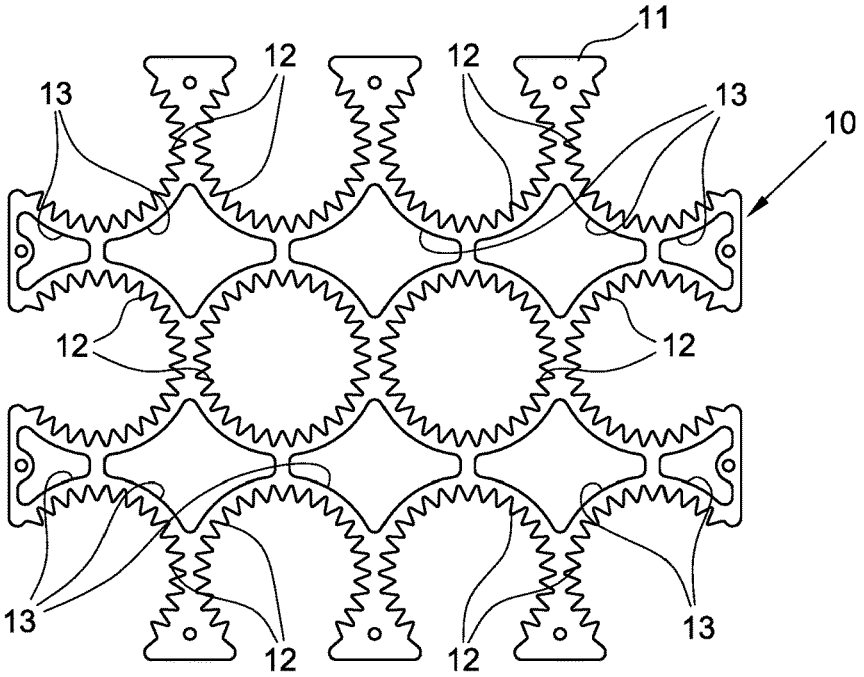
FIG. 7 is a top view of an accessory applicable to a bundle of containers, according to a first embodiment.
Figure 8:
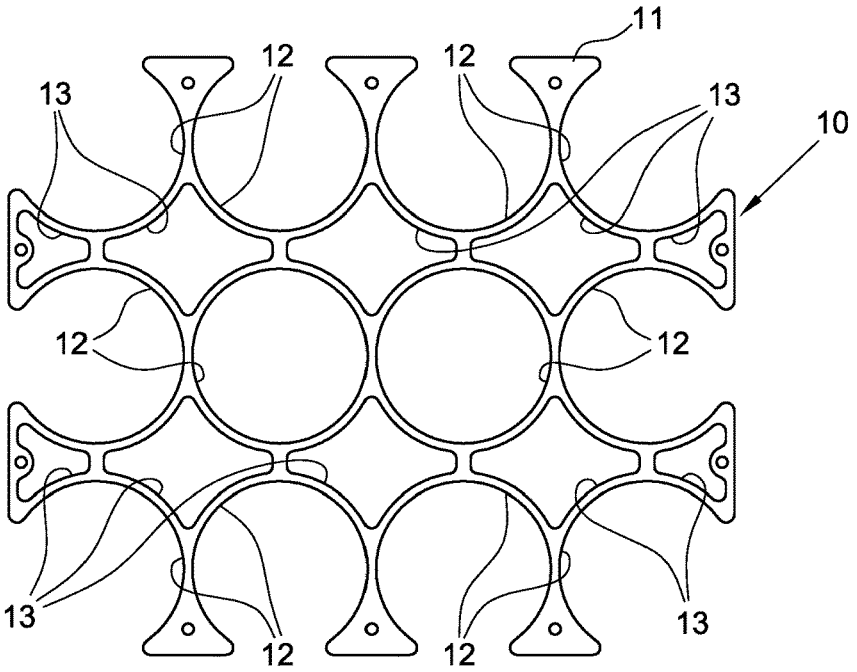
FIG. 8 is a top view of an accessory applicable to a bundle of containers, according to a second embodiment.

As observable in FIGS. 7 and 8, it is possible to provide for the presence of suitable spacer means 10 which can be introduced into the housing compartment 6 of the respective bundle 1 (FIG. 9) for spacing at least two adjacent containers 3 and define between the latter at least one interspace suitable for receiving the coolant 1*a*.

The spacer means 10 comprise at least one grid 11 having a substantially network-like structure which delimits a plurality of housing seats 12 for the engagement of a respective container 3 and a plurality of cavities 13, each interposed between at least two adjacent housing seats 12.

Advantageously, as illustrated in FIG. 8, each housing seat 12 has a substantially circular-shaped or circle arc-shaped profile, optionally smooth and/or continuous, in particular counter-shaped with respect to the profile, in transverse section, of the container 3 to be received.

According to a further advantageous aspect of the present invention, illustrated in FIG. 7, each housing seat 12 has a notched profile which develops in a substantially circular or circle arc manner.

Preferably, the notching of each housing seat is elastically yieldable to allow the interference fit of a respective container 3 to be received and simultaneous ensure the engagement of the same in the respective housing seat 12.

Figure 9:
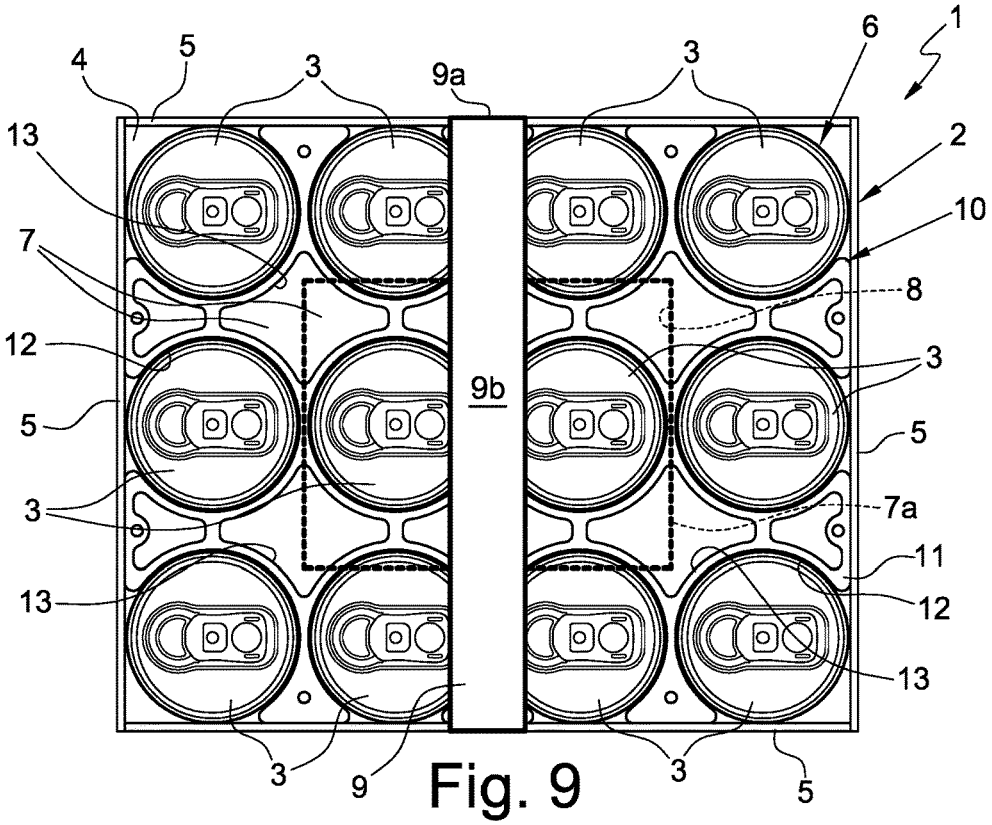
FIG. 9 is a top view representation of a bundle of containers provided with the accessory subject of FIG. 8.

Still with reference to FIGS. 7 to 9, wherein each cavity 13 has a substantially rhombus or triangular-shaped profile.

Figure 10:
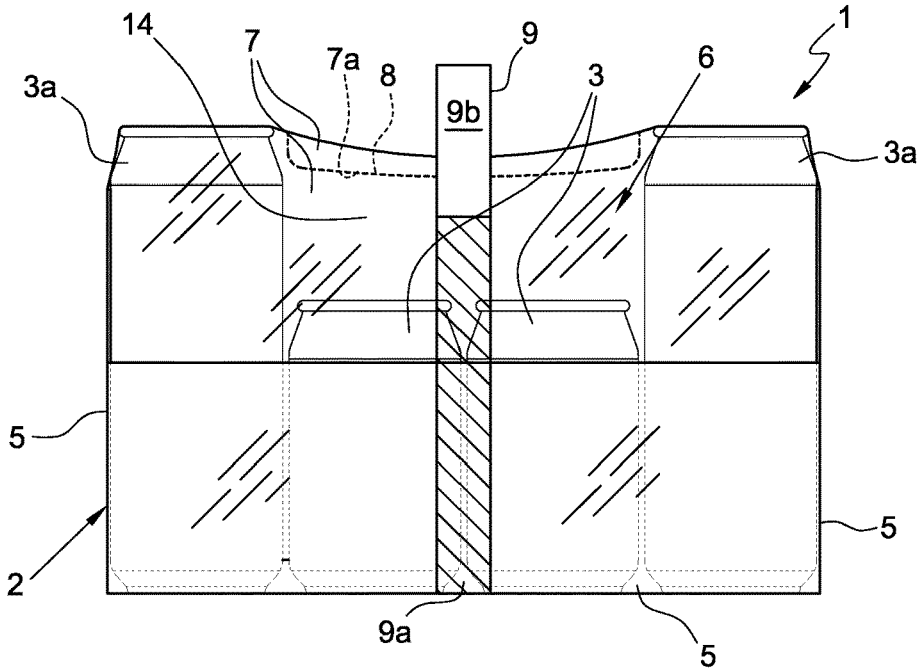
FIG. 10 is an elevational representation of an alternative version of the bundle of containers, according to the present invention.
Figure 11:
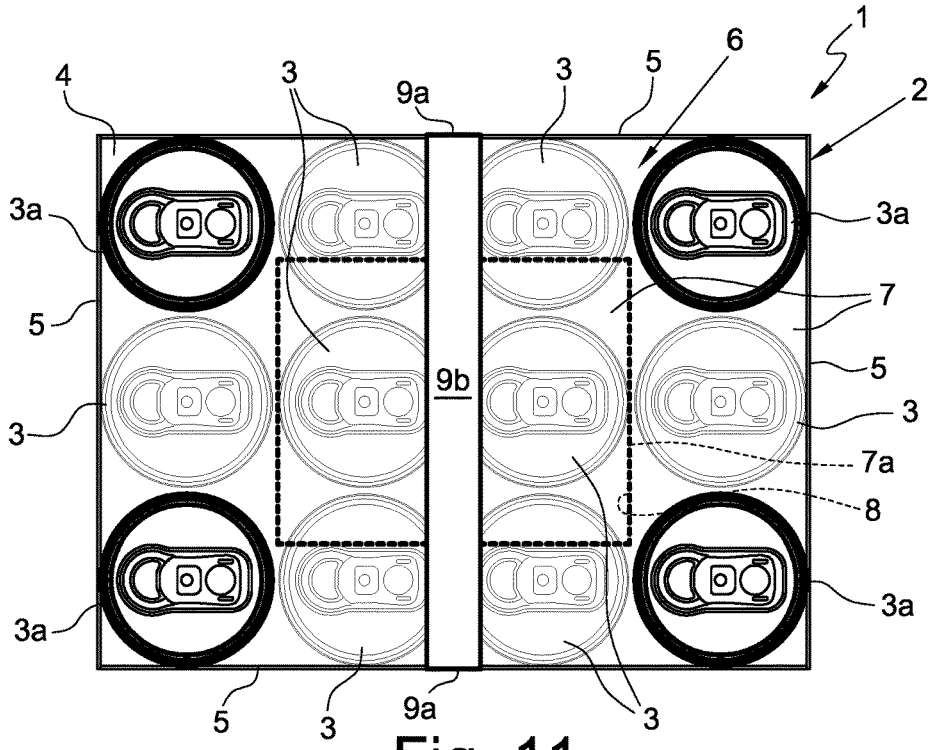
FIG. 11 is a top schematic representation of the bundle illustrated in FIG. 10.

According to the embodiment illustrated in FIGS. 10 and 11, the bundle 1 comprises at least one lifting element 3*a*, preferably a plurality of lifting elements 3*a*, arranged inside the housing compartment 6 for maintaining the wrapping 7 raised with respect to the containers 3.

Advantageously, each lifting element 3*a* comprises an auxiliary container (indicated with bold letters in FIG. 11) which has a greater height with respect to the height of the containers 3 (represented with a fine line in FIG. 11) so that the wrapping 7 engages at the upper part the auxiliary containers delimiting with the latter and the containers 3 an upper chamber 14 for housing the coolant 1*a*.

The bundle described above overcomes the problems observed in the prior art and attains important advantages.

First of all, the provision of a structure 2 for holding containers 3 impermeable allows the introduction of ice or a coolant liquid 1*a* inside the bundle so as to be able to cool the containers present therein without having to remove the same from the respective packaging.

The presence of the impermeable container 3 holder structure 2 also allows to contain the volume of water which is formed following the melting of the ice introduced into the bundle.

The bundle according to the present invention is thus transformed into an ice holder container which can be used in a simple and practical manner by anyone during any outdoor or social events by providing the access openings required for the introduction of ice or coolant liquid which is easily introduced from above by gravity.

Thus, the bundle described above allows to avoid the use of bulky ice containers into which bottles and/or cans are introduced after being removed from the bundles.

The invention claimed is:

1. Bundle of containers, comprising:

a structure for holding containers, comprising at least one base wall intended to support the containers and at least one lateral wall, extending transversely and perimetrically from the base wall to define a housing compartment open at the upper part and intended for supporting the containers, the housing compartment being impermeable for receiving a predefined amount of a coolant, the structure for holding containers being made of a single piece, starting from an impermeabilized cardboard sheet with paraffin and/or at least one resin and/or at least one other hydrophobic substance, or from a plasticized cardboard sheet, or from a rigid or semi-rigid plastic sheet;

a wrapping made of thermoretractable plastic material winding the structure for holding containers and the containers arranged therein, the wrapping comprising at least one access opening, for the introduction of the coolant in the housing compartment of the structure for holding containers, the access opening being defined in the wrapping by at least one structural weakening line, the wrapping being breakable or tearable along the weakening line for the formation of the access opening, the wrapping further comprising an adhesive disposed on the wrapping adjacent to the access opening, wherein the adhesive is constructed and arranged to close the access opening.

2. Bundle according to claim 1, wherein the sheet has a plurality of bending lines for the formation of the structure for holding containers, the bending lines being impermeabilised at least at the housing compartment.

3. Bundle according to claim 2, wherein the bending lines are obtained through a section reduction obtained on an outer surface opposite to an inner surface facing the housing compartment.

4. Bundle according to claim 1 wherein said lateral wall of said structure for holding containers extends vertically by at least one third of the height of the containers.

5. Bundle according to claim 1 wherein the lateral wall has portions with differentiated height.

6. Bundle according to claim 1, further comprising a sealing interposed between the structure for holding containers and the wrapping for preventing the leakage of the coolant from the housing compartment along the lateral wall, the sealing means developing externally on the structure for holding containers along the entire perimeter development of the housing compartment.

7. Bundle according to claim 6, wherein the sealing comprises at least one layer made of a sealing material applied substantially perimetrically, optionally peripherally, on the surface of the sheet intended to face towards the outside of the bundle, the sealing material being adapted to be welded or joined to the wrapping following an activation operation, preferably of mechanical and/or heating and/or chemical type.

8. Bundle according to claim 1, further comprising spacer which can be introduced into the housing compartment for spacing at least two adjacent containers and define between the latter at least one interspace suitable for receiving the coolant.

9. Bundle according to claim 8, wherein the spacer comprise at least one grid having a substantially network-like structure delimiting:

a plurality of housing seats for the engagement of a respective container;

a plurality of cavities, each interposed between at least two adjacent seats, at least partially defining the interspaces.

10. Bundle according to claim 9, wherein each housing seat has a substantially circular-shaped or circle arc-shaped profile, optionally smooth and/or continuous, preferably counter-shaped with respect to the profile, in cross section, of a respective container to be received.

11. Bundle according to claim 9, wherein each housing seat has a notched profile which develops substantially in a circular or circle arc manner.

12. Bundle according to claim 9, wherein each cavity has a substantially rhombus or triangular-shaped profile.

13. Bundle according to claim 1, further comprising at least one lifting element, preferably a plurality of lifting elements, arranged inside the housing compartment for maintaining the wrapping raised with respect to the containers.

14. Bundle according to claim 13, wherein each lifting element comprises an auxiliary container having a greater height with respect to the height of the containers.

15. Bundle according to claim 1, wherein the containers are selected from the group consisting of: bottles and cans.

16. Bundle according to claim 1, wherein the coolant is selected from the group consisting of: a liquid coolant, a solid coolant, and ice.

17. Bundle according to claim 4, wherein said lateral wall of said structure for holding containers extends vertically by half of the height of the held containers.

18. Bundle according to claim 4, wherein said lateral wall of said structure for holding containers extends vertically by two thirds of the height of the held containers.

19. Assembly comprising:

a structure for holding containers, comprising at least one base wall intended to support one or more containers and at least one lateral wall, extending transversely and perimetrically from the base wall to define a housing compartment open at the upper part and intended for supporting the containers, the housing compartment being impermeable for receiving a predefined amount of a coolant, said structure for holding containers being made of a single piece, starting from an impermeabilized cardboard sheet with paraffin and/or at least one resin and/or at least one other hydrophobic substance, or from a plasticized cardboard sheet, or from an optionally rigid or semi-rigid plastic sheet;

at least one container;

at least one auxiliary container, each having a greater height with respect to the height of at least one container;

a wrapping made of thermoretractable plastic material winding the structure for holding containers and the containers arranged therein, the wrapping engaging at the upper part at least one auxiliary containers so as to delimit with the at least one auxiliary container and at least one containers an upper chamber for housing the coolant, the wrapping comprising at least one access opening, for the introduction of the coolant in the housing compartment of the structure for holding containers, the access opening being defined in the wrapping by at least one structural weakening line, the wrapping being breakable or tearable along the weakening line for the formation of the access opening, the wrapping further comprising an adhesive disposed on the wrapping adjacent to the access opening, wherein the adhesive is constructed and arranged to close the access opening.

20. Assembly according to claim 19, wherein the coolant is selected from the group consisting of: a liquid coolant, a solid coolant, and ice.

* * * * *